US009225127B2

(12) United States Patent
Rose et al.

(10) Patent No.: US 9,225,127 B2
(45) Date of Patent: Dec. 29, 2015

(54) CONNECTION ILLUMINATION USING COMMUNICATION ELEMENTS

(71) Applicant: Lenovo (Singapore) Pte. Ltd., Singapore (SG)

(72) Inventors: Amy Leigh Rose, Chapel Hill, NC (US); John Scott Crowe, Durham, NC (US); Jennifer Lee-Baron, Raleigh, NC (US); John Edward Long, Jr., Raleigh, NC (US); Nathan J. Peterson, Durham, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 24 days.

(21) Appl. No.: 13/847,816

(22) Filed: Mar. 20, 2013

(65) Prior Publication Data

US 2014/0287615 A1 Sep. 25, 2014

(51) Int. Cl.
*H01R 13/717* (2006.01)
*H01R 13/66* (2006.01)

(52) U.S. Cl.
CPC ..... *H01R 13/7175* (2013.01); *H01R 13/6683* (2013.01)

(58) Field of Classification Search
CPC ..... H01R 13/7175; H01R 13/717; H01R 13/6683
USPC ..... 439/490
See application file for complete search history.

(56) References Cited

U.S. PATENT DOCUMENTS

| | | | | | |
|---|---|---|---|---|---|
| 4,118,690 | A * | 10/1978 | Paynton | 340/656 |
| 4,350,407 | A * | 9/1982 | Tong | 439/490 |
| 4,671,597 | A * | 6/1987 | Grill | 362/253 |
| 5,567,175 | A * | 10/1996 | Warden et al. | 439/490 |
| 7,004,595 | B1 * | 2/2006 | Stoddard | 362/95 |
| 8,378,631 | B2 | 2/2013 | Ron et al. | |
| 8,740,640 | B2 * | 6/2014 | Hardy | 439/490 |
| 2004/0242087 | A1 * | 12/2004 | Hoshina | 439/894 |
| 2006/0039136 | A1 * | 2/2006 | Probasco et al. | 362/157 |
| 2006/0044148 | A1 * | 3/2006 | Daniels et al. | 340/686.1 |
| 2006/0148279 | A1 * | 7/2006 | German et al. | 439/49 |
| 2007/0149013 | A1 * | 6/2007 | Eastham et al. | 439/140 |
| 2007/0178742 | A1 * | 8/2007 | Shigemi et al. | 439/394 |
| 2008/0102689 | A1 * | 5/2008 | Dhir | 439/490 |
| 2009/0269967 | A1 * | 10/2009 | Shigemi et al. | 439/374 |
| 2011/0008996 | A1 * | 1/2011 | Pinn et al. | 439/489 |
| 2011/0045688 | A1 * | 2/2011 | Shigemi et al. | 439/488 |
| 2011/0050171 | A1 | 3/2011 | Ron et al. | |
| 2011/0097925 | A1 * | 4/2011 | Caveney et al. | 439/488 |
| 2012/0045928 | A1 * | 2/2012 | Caveney et al. | 439/488 |
| 2012/0187961 | A1 * | 7/2012 | Hashim et al. | 324/649 |
| 2012/0188865 | A1 * | 7/2012 | Michaelis et al. | 370/200 |
| 2013/0039624 | A1 * | 2/2013 | Scherer et al. | 385/92 |
| 2013/0078848 | A1 * | 3/2013 | Kummetz | 439/488 |
| 2013/0099736 | A1 | 4/2013 | Roberts et al. | |
| 2013/0260603 | A1 * | 10/2013 | Caveney et al. | 439/490 |
| 2014/0141649 | A1 * | 5/2014 | Standish et al. | 439/620.01 |

* cited by examiner

*Primary Examiner* — Ross Gushi
(74) *Attorney, Agent, or Firm* — Ference & Associates LLC

(57) ABSTRACT

An aspect provides a plug including: a connection element for connecting to a port of an information handling device; a detection element disposed within the plug; and an illumination source disposed within the plug; the detection element controlling illumination of the illumination source via detecting the information handling device. Other aspects are described and claimed.

20 Claims, 3 Drawing Sheets

CONNECTION ILLUMINATION USING COMMUNICATION ELEMENTS

BACKGROUND

Information handling devices ("devices") come in a variety of forms, for example laptop computing devices, tablet computing devices, smart phones, e-readers, MP3 players, and the like. Many such devices are mobile and thus configured for use with a rechargeable battery.

The rechargeable battery may be charged via a wired connection. Wired charging connection arrangements ("connections") operate to supply current for recharging the battery via a plug or connector, transferring charging current from a commercial power source outlet to the device's rechargeable battery. There are many different types of connections. Many designs of connections are "keyed". That is, the plug end of the wire includes a connector element that fits into a port on the device, but each of the connector element of the plug and the port of the device is designed asymmetrically. This helps to ensure that the plug is inserted in the proper orientation into the device's charging port. Additionally, connections and keyed connections are used for other purposes, e.g., data connections such as USB, and other connections (combined) are utilized for combined charging/data transmission.

BRIEF SUMMARY

In summary, one aspect provides a plug comprising: a connection element for connecting to a port of an information handling device; a detection element disposed within the plug; and an illumination source disposed within the plug; the detection element controlling illumination of the illumination source via detecting the information handling device.

Another aspect provides a method, comprising: bringing a detection element disposed within a plug into a predetermined proximity of a detection element of an information handling device; and illuminating an illumination source of the plug in response to the detection elements being brought into the predetermined proximity of one another.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1B:
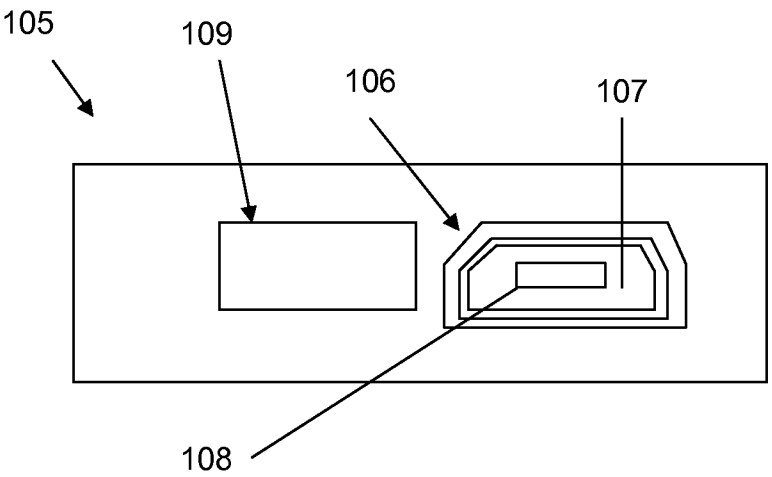
FIG. 1(A-B) illustrates an example plug and device.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Specific examples are described herein with respect to charging connections. However, it will be readily apparent to those having ordinary skill in the art that the charging connection based examples may be extended to other connections such as data connections and/or combined charging/data connections.

An example of a keyed connection arrangement ("plug") is illustrated in FIG. 1(A-B). The plug 100 includes a connection element 101 and a wire 102 connected by an intermediary element 103. The wire 102, in the case of a charging connection, provides power to the plug 100 generally and to the connection element 101 specifically for charging another device, e.g., device 105. The wire 102 in such a charging connection scenario thus includes an end that connects to a commercial power outlet and an end that includes a plug 100 and a connection for a port 106 of a device 105. The intermediary element 103 may include a detection element or component that communicates with or is detectable by a detection element 109 of the device 105. The device 105 may have a battery to be charged. Again, alternatively the plug 100 may be a data only plug or a combination plug for transmitting power and data.

Figure 1A:
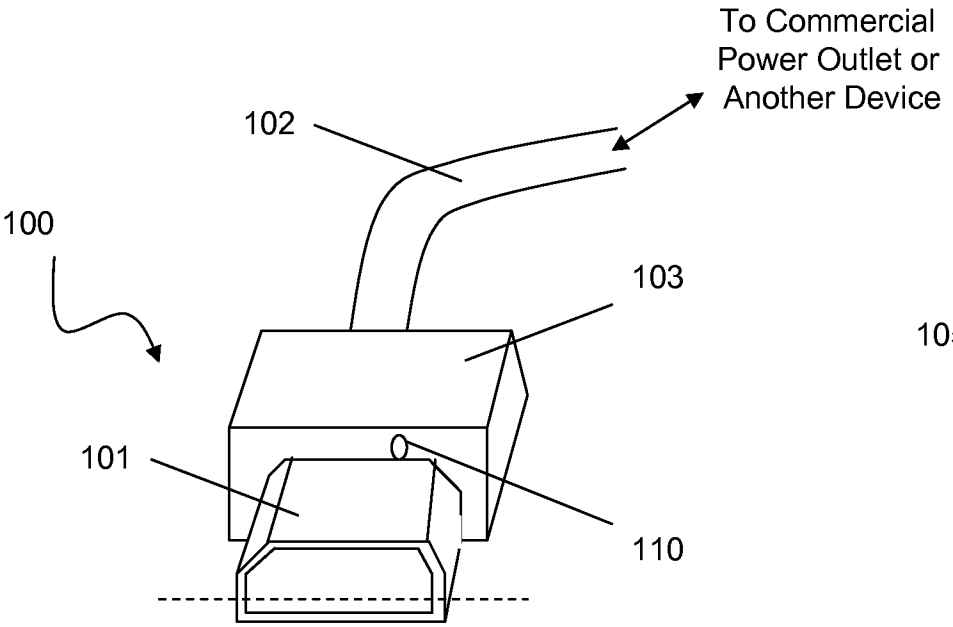

Referring to FIG. 1A-B, the connection element 101 connects to a port 106 of the device 105 and physically contacts a contact element 108 through which charging current and/or data may be supplied. Thus, in the case of a charging connection power from the wire 103 travels through the contact element 108 of the device 105.

The connection element 101 illustrated is keyed, i.e., is asymmetric about a plane (indicated by the dashed line), as is the port 106 of the device 105. Particularly, the shape of the connection element 101 matches the fittings of the port 106 such that the connection element enters into a space 107 and is able to contact the contact element 108 of the device 105. There connecting element 101 of the plug 100 therefore is only connectable to the port 106 of the device 105 in a certain orientation.

A keyed arrangement, while useful for ensuring appropriate connection between plug 100 and device 105, complicates use because it requires a particular orientation of the plug 100 relative to the device 105 in order to insert the connection element 101 into the port 106. This oftentimes is difficult, for example in low light conditions. Moreover, the plug 100 is oftentimes small in form, making visual identification of the proper orientation quite difficult, especially under low light conditions. It will be appreciated that the small form of the plugs (e.g., combined USB/power plug of a smart phone or tablet) makes insertion of the connection element 101 into the port 106 of the device 105 difficult even if the connection is not keyed. Such difficulties in determining the proper orientation of the connection elements (e.g. plug 101 and port 106) is therefore quite difficult in certain circumstances, e.g., in low light.

Accordingly, an example embodiment provides an illumination feature, for example included with the intermediary element 103 in the form of a light emitting diode (LED) 110 or other suitable source of illumination. In one example, the illumination feature leverages short range communication or sensing to provision light such that, under low light conditions such as at night, a user is supplied with additional light in order to effect a connection between the plug 100 and the port 106 of the device 105.

In an example configuration, the intermediary element 103 of the plug 100 may include a short range communication feature such as a radio frequency identification (RFID) element (e.g., RFID chip). This short range communication feature may take a variety of forms but includes an element that is detectable, e.g., by a device 105 or component or subsystem thereof, such as detection element 109, based on proximity, e.g. on the order of centimeters. For near field communication elements, as an example, the proximity range may be about 10 cm or less.

For example, the device 105 may include a detection element 109 including an RFID reader that detects an RFID chip of the intermediary element 103. In the example of an RFID arrangement, intermediary element 103 includes an RFID chip or tag that is read or detected by an RFID chip or tag reader of the detection element 109 of the device 105. Other short range communication or sensing mechanisms may be employed.

The RFID chip of the intermediary element 103 may be detected in a variety of ways. An example includes modulation of a field produced by the detection element 109 of the device 105, for example when intermediary element 103 is brought into a predetermined proximity of (in the field of) the detection element 109. This modulation of the field about detection element 109 may be detected and act as a signal. A signal thus detected may be utilized to activate a source of illumination, for example switch on power (e.g., from the wire) to the LED 110 of plug 100.

Additionally or alternatively, the device 105 may include a detection element 109 such as an RFID reader that detects an RFID chip of the intermediary element 103 and provides sufficient power to the intermediary element 103 such that a source of illumination, e.g., LED 110, of the intermediary element 103 is powered by the near field communication. Thus, the LED 110 may be detected (by association with intermediary element 103) and turned on based on proximity of the NFC elements 103, 109 of the plug 100 and the device 105.

Figure 2:
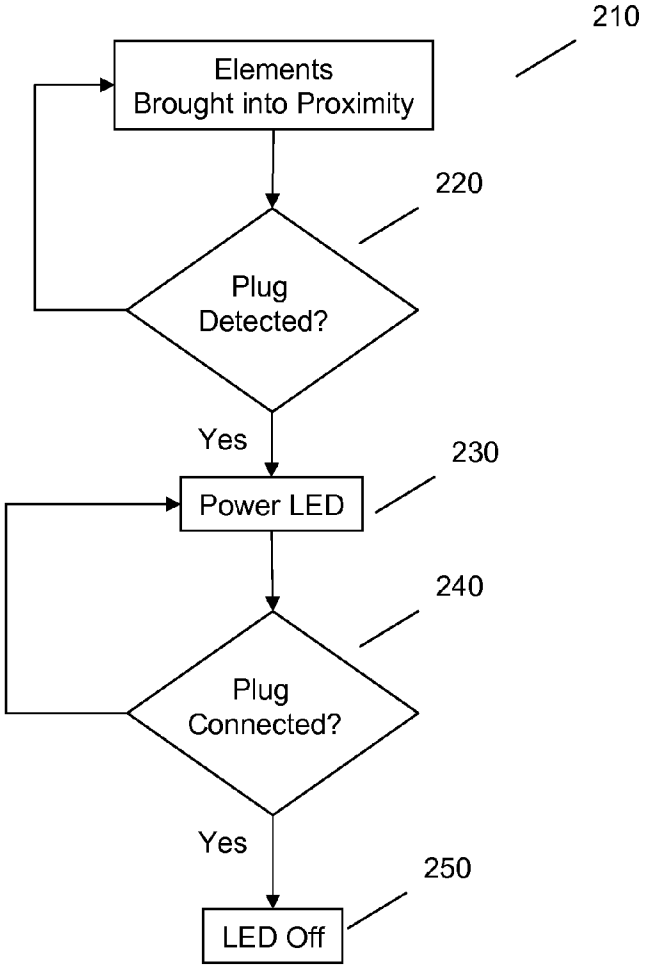
FIG. 2 illustrates an example method of connection illumination using communication elements.

Referring now to FIG. 2, therein is illustrated an example method of connector illumination. At 210 a user brings the plug 100 and the device 105 into a predetermined proximity. This permits the detection elements to be located proximate to one another. For example, intermediary element 103 and detection element thereof are brought near the detection element 109 of the device. This in turn permits the detection elements to be detected using, e.g., near field communication. Thus, the plug 100 may be detected as proximate to the device 105 at step 220.

When the plug 100 is detected at 220, an illumination source, e.g., LED 110 of intermediary element 103, may be powered at step 230. This may take a variety of forms, as described herein. For example, an LED may be powered by the near field communication, the LED 110 may be powered via power received from a wire 102, etc. With the illumination source powered, illumination is provided such that a user may more readily see the port 106 of the device 105 for inserting the insertion element 101. Moreover, the additional illumination provided by the plug 100 (or component thereof) provides an aid in properly orienting the plug 100 with respect to the port 106 of the device 105, assisting users of "keyed" connectors.

In this respect, referring back to FIG. 1A, the source of illumination, e.g., LED 110, may be positioned in a useful way. In the example of FIG. 1A, the LED 110 is placed on a certain, keyed side of the connector element 101. This allows the user to remember that the illumination source, e.g., LED 110, is oriented in a certain way. This in turn will assist the user in attempts to insert the insertion element 101 into the port 106 when a keyed connector is utilized.

Optionally, the connection of the plug 100 into the port 106 also may be utilized to control illumination. For example, at step 240 the plug 100 is detected as being connected to the port 106, which may be utilized (e.g., by device 105 or by intermediary element 103, or the like) as a signal that the LED 110 should be powered off.

In other examples, certain components may be rearranged depending on the desired implementation, components, etc. For example, other communication techniques, components or elements may be utilized other than near field communication elements. Additionally, other arrangements of components may be utilized, such as rearranging the positioning of the LED 110 or other illumination source on the plug 100, moving the LED 110 or other illumination source to another component, for example the device, or other suitable combinations.

Figure 3:
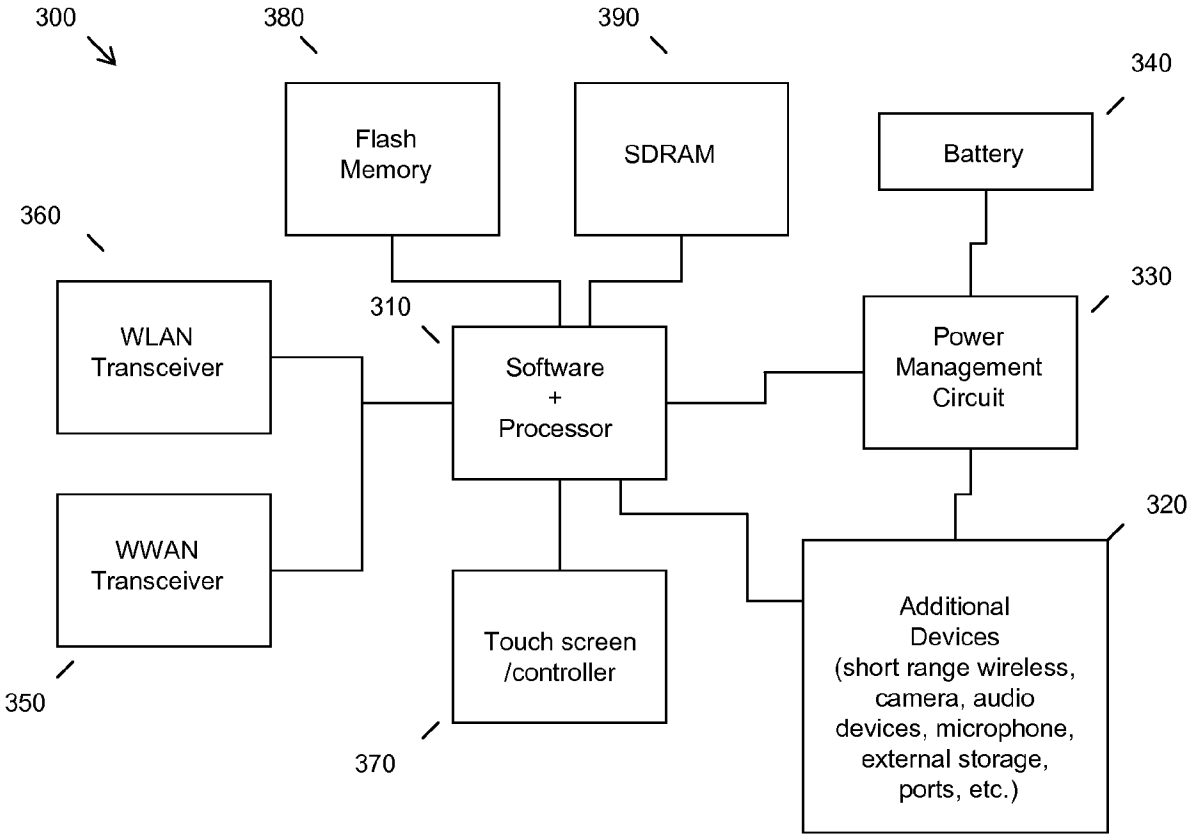
FIG. 3 illustrates an example of information handling device circuitry.

Referring to FIG. 3, while various other circuits, circuitry or components may be utilized, with regard to laptop, smart phone and/or tablet circuitry 300, an example illustrated in FIG. 3 includes an ARM based system (system on a chip) design, with software and processor(s) combined in a single chip 310. Internal busses and the like depend on different vendors, but essentially all the peripheral devices (320) may attach to a single chip 310. The circuitry 300 combines the processor, memory control, and I/O controller hub all into a single chip 310. Also, ARM based systems 300 do not typically use SATA or PCI or LPC. Common interfaces for example include SDIO and I2C.

There are power management chip(s) 330, e.g., a battery management unit, BMU, which manage power as supplied for example via a rechargeable battery 340, which may be recharged by a connection to a power source such as provided by a connector, e.g., plug and port arrangement shown as an illustrative example in FIG. 1(A-B). The circuitry 300 may thus be included in a device such as the information handling device of FIG. 1B. In at least one design, a single chip, such as 310, is used to supply BIOS like functionality and DRAM memory.

ARM based systems 300 typically include one or more of a WWAN transceiver 350 and a WLAN transceiver 360 for connecting to various networks, such as telecommunications networks and wireless base stations. Commonly, an ARM based system 300 will include a touch screen 370 for data input and display. ARM based systems 300 also typically include various memory devices, for example flash memory 380 and SDRAM 390.

Information handling devices, as for example outlined in FIG. 1B and FIG. 3, may include ports for wired charging connections, e.g., connector as illustrated in FIG. 1(A-B), to recharge a rechargeable battery, e.g., battery 340. It should be noted, however, that the example device of FIG. 1B and circuitry of FIG. 3 are examples only, and other devices and circuitry may be used. Moreover, although RFID communication techniques have been focused on herein, embodiments may be implemented using other suitable communication or sensing techniques.

As will be appreciated by one skilled in the art, various aspects may be embodied as a system, method or device program product. Accordingly, aspects may take the form of an entirely hardware embodiment or an embodiment including software that may all generally be referred to herein as a "circuit," "element" or "system." Furthermore, aspects may take the form of a device program product embodied in one or more device readable medium(s) having device readable program code embodied therewith.

Any combination of one or more non-signal device readable medium(s) may be utilized. The non-signal medium may be a storage medium. A storage medium may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider) or through a hard wire connection, such as over a USB connection.

Aspects are described herein with reference to the figures, which illustrate example methods, devices and program products according to various example embodiments. It will be understood that the actions and functionality may be implemented at least in part by program instructions. These program instructions may be provided to a processor of a general purpose information handling device, a special purpose information handling device, or other programmable data processing device or information handling device to produce a machine, such that the instructions, which execute via a processor of the device implement the functions/acts specified.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A plug comprising:

a connection element for connecting to a port of an information handling device;

a detection element disposed within the plug; and an illumination source disposed within the plug;

the detection element controlling illumination of the illumination source via detecting the information handling device;

wherein the detection element does not receive identification data unique to the port of an information handling device;

wherein the illumination source, when illuminated, provides illumination of the port of the information handling device.

2. The plug of claim 1, wherein the detection element comprises a near field communication element, and wherein detecting the information handling device comprises entering into a field of a near field communication element of the information handling device.

3. The plug of claim 2, wherein the detection element of the plug powers the illumination source via powering the illumination source with energy derived from the near field communication element of the information handling device.

4. The plug of claim 2, wherein the detection element of the plug powers the illumination source via using detection of the near field communication element of the information handling device to produce a signal for switching power on to the illumination source.

5. The plug of claim 4, further comprising a wire, wherein the wire provides power to the plug, and wherein said signal switches on power derived from the wire and the power is provided from the wire to the illumination source.

6. The plug of claim 2, wherein the near field communication element of the plug comprises an RFID element.

7. The plug of claim 1, wherein the illumination source comprises a light emitting diode (LED).

8. The plug of claim 1, wherein:

the connection element for connecting to a port of an information handling device comprises a keyed connection element; and the illumination source is disposed in the plug at a particular orientation with respect to the keyed connection element.

9. A method, comprising:

detecting a detection element disposed within a plug is within a predetermined proximity of a detection element of an information handling device; and illuminating an illumination source of the plug in response to the detection elements being brought into the predetermined proximity of one another;

wherein the detection element does not receive identification data unique to the port of an information handling device;

wherein the illumination source, when illuminated, provides illumination of a port of the information handling device.

10. The method of claim 9, wherein the detection element disposed within a plug comprises a near field communication element, and wherein the detection element of the information handling device comprises a near field communication element.

11. The method of claim 10, wherein detecting a detection element disposed within the plug is within a predetermined proximity of a detection element of an information handling device comprises detecting the detection element has entered into a field of the near field communication element of the information handling device.

12. The method of claim 10, wherein illuminating the illumination source comprises powering the illumination source with energy derived from the near field communication element of the information handling device.

13. The method of claim 10, wherein illuminating the illumination source comprises powering the illumination source via using detection of the near field communication element of the information handling device to produce a signal for switching power on to the illumination source.

14. The method of claim 13, wherein said signal switches on power derived from a wire providing power to the plug and the power is provided from the wire to the illumination source.

15. The method of claim 10, wherein the near field communication element of the plug comprises an RFID element, and wherein the near field communication element of the information handling device comprises an RFID element.

16. The method of claim 9, wherein the illumination source comprises a light emitting diode (LED).

17. The method of claim 9, wherein illuminating an illumination source of the plug comprises illuminating the illumination source prior to a connector element of the plug contacting a port of the information handling device.

18. The method of claim 17, further comprising removing illumination of the illumination source after the connector element of the plug contacts the port of the information handling device.

19. The method of claim 9, wherein the predetermined proximity comprises about 10 cm or less.

20. An information handling device, comprising:

a processor;

a memory operative coupled to the processor;

a port for connection of a plug, the port being operatively connected to the processor and comprising a detection element;

the detection element, upon detecting the plug, providing a signal to the plug causing an illumination source of the plug to illuminate;

wherein the detection element does not provide identification data unique to the port.

* * * * *